US007487720B2

(12) United States Patent
Bundren et al.

(10) Patent No.: US 7,487,720 B2
(45) Date of Patent: Feb. 10, 2009

(54) METHOD OF MAKING A BALE OF CELLULOSE ACETATE TOW

(75) Inventors: Christopher M. Bundren, Blacksburg, VA (US); Ronald F. Hughes, Narrows, VA (US)

(73) Assignee: Celanese Acetate LLC, Dallas, TX (US)

( * ) Notice: Subject to any disclaimer, the term of this patent is extended or adjusted under 35 U.S.C. 154(b) by 0 days.

(21) Appl. No.: 12/039,157

(22) Filed: Feb. 28, 2008

(65) Prior Publication Data

US 2008/0216674 A1 Sep. 11, 2008

Related U.S. Application Data

(60) Provisional application No. 60/892,959, filed on Mar. 5, 2007.

(51) Int. Cl.
*B65B 13/02* (2006.01)
*B65B 13/20* (2006.01)

(52) U.S. Cl. ..... 100/3; 100/295; 53/438

(58) Field of Classification Search ..... 100/1, 100/2, 3, 295; 53/436, 438, 523, 526, 529
See application file for complete search history.

(56) References Cited

U.S. PATENT DOCUMENTS

| | | | | |
|---|---|---|---|---|
| 159,378 | A | 2/1875 | Baldwin | |
| 206,658 | A | 8/1878 | Blossom | |
| 705,134 | A | 7/1902 | Pope et al. | |
| 2,947,241 | A | 8/1960 | Guenther et al. | |
| 2,947,242 | A | 8/1960 | Guenther et al. | |
| 3,063,363 | A | 11/1962 | Lamb | |
| 3,351,992 | A | 11/1967 | Carter | |
| 3,683,795 | A * | 8/1972 | Harris | 100/347 |
| 3,991,670 | A | 11/1976 | Stromberg | |
| 4,092,912 | A | 6/1978 | Simich | |
| 4,162,603 | A | 7/1979 | Stromberg | |
| 4,324,176 | A | 4/1982 | McCormick | |

(Continued)

FOREIGN PATENT DOCUMENTS

| | | |
|---|---|---|
| DE | 29615598 U1 | 2/1997 |

(Continued)

OTHER PUBLICATIONS

C. L. Browne, "The Design of Cigarettes," Hoechst Celanese Corporation, (Apr. 17, 1990).

*Primary Examiner*—Jimmy T Nguyen
(74) *Attorney, Agent, or Firm*—Hammer & Associates, P.C.

(57) ABSTRACT

A method for baling a cellulose acetate tow is disclosed. The method includes the following steps: laying the cellulose acetate tow into a can; pressing the laid tow with a press having a first platen and a second platen, each platen facing each other, each platen having a contoured face, the contoured face having at least three sloped portions, a first sloped portion located adjacent a peripheral edge of the platen having a first slope, a second sloped portion located adjacent the first sloped portion having a second slope, and a third sloped portion located adjacent the second sloped portion having a third slope, wherein the first slope is greater that the second slope, and the second slope is greater that the third slope; and packaging and securing the pressed tow; whereby the pressed tow having substantially flat surfaces.

8 Claims, 2 Drawing Sheets

U.S. PATENT DOCUMENTS

| | | | |
|---|---|---|---|
| 4,366,751 | A | 1/1983 | Spaller, Jr. |
| 4,393,767 | A | 7/1983 | Dutfield |
| 4,577,752 | A | 3/1986 | Meredith, Jr. |
| 5,701,723 | A | 12/1997 | Simpson |
| 5,732,531 | A | 3/1998 | deSilva et al. |
| 5,852,969 | A | 12/1998 | Anthony |
| 6,474,226 | B1 | 11/2002 | Sutton et al. |
| 2004/0159658 | A1 | 8/2004 | McLaughlin et al. |
| 2005/0161358 | A1 | 7/2005 | Kern |
| 2006/0243142 | A1 | 11/2006 | Mullins et al. |
| 2006/0249406 | A1 | 11/2006 | Sanderson et al. |

FOREIGN PATENT DOCUMENTS

| | | | |
|---|---|---|---|
| GB | 896228 | | 5/1962 |
| JP | 2004-34062 | | 8/2005 |
| WO | WO 02/32238 | | 4/2002 |
| WO | WO 03/089309 | A2 | 10/2003 |
| WO | WO 2006/115973 | A1 | 11/2006 |

* cited by examiner

METHOD OF MAKING A BALE OF CELLULOSE ACETATE TOW

RELATED APPLICATION

This application claims the benefit of U.S. Provisional Patent Application Ser. No. 60/892,959 filed Mar. 5, 2007.

FIELD OF THE INVENTION

This invention is related to a method of making a bale of tow (continuous filaments), such as cellulose acetate tow, having flat or substantially flat surfaces.

BACKGROUND OF THE INVENTION

Cellulose acetate tow is a material that is shipped in bales. Tow refers to a continuous band (or bundle) of filaments. Typically, the tow is drawn directly from the bale (i.e., de-baling) for subsequent processing. Therefore, it is important that the tow can be drawn from the bale without difficulty. Moreover, these bales should be stackable which typically means that these bales should have flat or substantially flat surfaces.

In the production of the tow bale, it is necessary to compact (or press) the tow to form the bale. Tow compaction, which is performed in a press, can lead to several problems. One such problem is bales with rounded (i.e., 'not flat' or 'crowned') tops and bottoms. This is a problem, during storage, handling, and shipping, because the rounded bales can not be stacked easily and have a tendency to tip. Another problem arising during compaction is that the tow can become entangled (i.e., the layers of tow are intermingled). This is a problem, during de-baling of the tow, because the entangled tow may not be easily removed from the bale.

In the recent past, several in the cellulose acetate industry have addressed the problem of rounded bales.

In US Patent Publication No. 2005/0161358, a bale with substantially flat sides (i.e., the top and bottom) is made by a technique in which the compressed tow is packaged in an air-tight wrap. When the tow expands, after release of the pressure on the tow, the tow springs back, somewhat, creating a vacuum within the air-tight wrap. The internal pressure created by the vacuum is enough to keep the sides substantially flat.

In US Patent Publication No. 2004/0159658, a bale with substantially flat sides (i.e., the top and bottom) is made by a technique in which the compressed tow is packaged in an air-tight wrap and then a vacuum (i.e., from an external source) is drawn within the wrapped tow.

In US Patent Publication No. 2006/0243142, a bale with substantially flat sides (i.e., top and bottom) is made by a technique where the tow is compressed between two protruding surfaces. These protruding surfaces may be convex, ellipsoidal, spherical, polyhedral (i.e., tetrahedral or pyramidal) or have curved or straight linear profiles. US Patent Publication No. 2006/0243142 at Paragraph [0036] and FIGS. 1 and 4. This technique uses long 'press cycles' of 10 and 20 minutes. Ibid., Table 1.

In US Patent Publication No. 2006/0249406, a bale with substantially flat sides (i.e., the top and bottom) is made by a technique where the tow is compressed between two platens with convex surfaces. The convex surfaces are a smooth surface, e.g., continuous, faceted, or stepped. US Patent Publication No. 2006/0249406, Paragraph [0022] and FIGS. 2 and 3. This technique uses compression period of about 1 second to several minutes. Ibid., Paragraph [0023].

There is a need for a method to make bales of cellulose acetate tow that have substantially flat sides (e.g., the top and bottom) and which the tow may be easily de-baled.

DESCRIPTION OF THE DRAWINGS

For the purpose of illustrating the invention, there is shown in the drawings a form that is presently preferred; it being understood, however, that this invention is not limited to the precise arrangements and instrumentalities shown.

SUMMARY OF THE INVENTION

A method for baling a cellulose acetate tow is disclosed. The method includes the following steps: laying the cellulose acetate tow into a can; pressing the laid tow with a press having a first platen and a second platen, each platen facing each other, each platen having a contoured face, the contoured face having at least three sloped portions, a first sloped portion located adjacent a peripheral edge of the platen having a first slope, a second sloped portion located adjacent the first sloped portion having a second slope, and a third sloped portion located adjacent the second sloped portion having a third slope, wherein the first slope is greater that the second slope, and the second slope is greater that the third slope; and packaging and securing the pressed tow; whereby the pressed tow having substantially flat surfaces.

DESCRIPTION OF THE INVENTION

Figure 1:
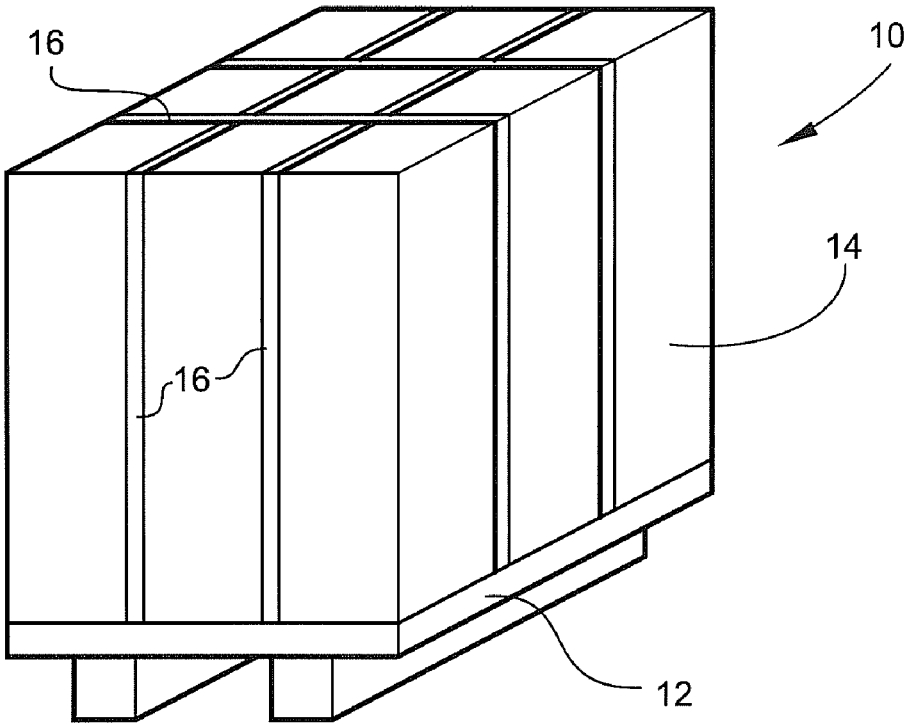
FIG. 1 is an illustration of a bale of tow.

Referring to the figures where like numerals indicate like parts, there is shown in FIG. 1 a bale 10 of tow. Bale 10 is placed atop pallet 12. Bale 10 is preferably surrounded with a wrapping 14. Bale 10 may also include strapping 16.

Bales of cellulose acetate tow may have dimensions in the range of 30 inches (76 cm) to 60 inches (152 cm) in height, 46 inches (117 cm) to 56 inches (142 cm) in length and 35 inches (89 cm) to 45 inches (114 cm) in width. Bales of cellulose acetate typically range in weight from 900 pounds (408 Kg) to 2100 pounds (953 Kg).

Figure 2:
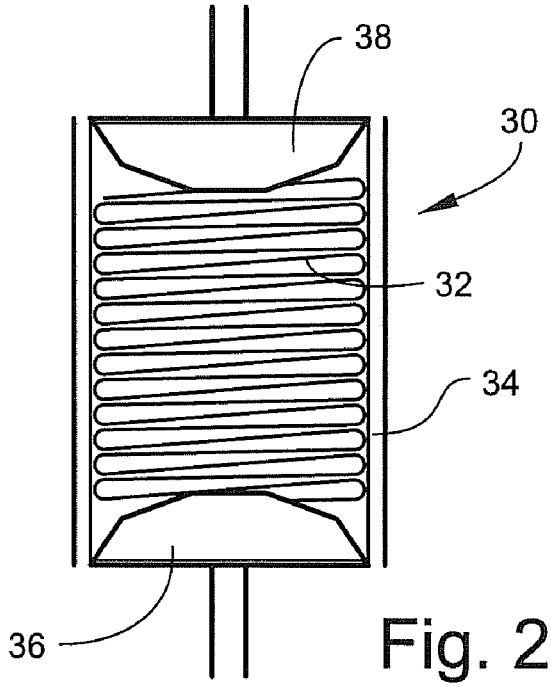
FIG. 2 is a schematic illustration of a bale press with tow therein, parts broken away for clarity.

Referring to FIG. 2, there is shown a schematic representation of a bale press 30. Bale press 30 may be any conventional press which is capable of exerting between 70 to 700 psi onto the tow. Bale press 30 includes a lower platen 36 and an upper platen 38. The upper and lower platens have no air exhaust holes (i.e., holes through the platen through which air escapes from the fibers as they are compressed), and may include strapping slots (i.e., slots cut into the face of a platen through which strapping may pass to surround the bale when compressed).

Generally, tow 32 is laid into a can at a remote location (not shown). Then, the tow 32 is transferred from the can and set into the press 30 within the press walls 34 and between dressed platens (dressed refers to wrapping 14 or a portion of the wrapping 14). The lower surface of the tow 32 rests atop the dressed lower platen 36. The upper surface of the tow 32 in can 34 is engaged by the dressed upper platen 38 as that platen is lowered to compress the tow 32. The platens 36 and 38 are discussed in greater detail below. It is understood that that the lower platen 36 may be the active platen and the upper platen 38 may be the stationary platen. The press 30 then compresses the tow for a given period of time (discussed in greater detail below). After compression, pressure on the bale is released (e.g., by retracting the platens), and the compressed bale is allowed to expand from 2 to 25% of its maximum compressed height. The expanded bale is fully wrapped and strapping is applied. This wrapped and strapped bale has flat or substantially flat surfaces and the tow may be easily de-baled.

Figure 3:
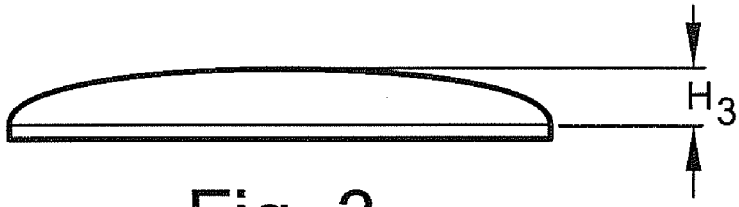
FIG. 3 is a cross-sectional view of the platen according to the first embodiment of the present invention.
Figure 4:
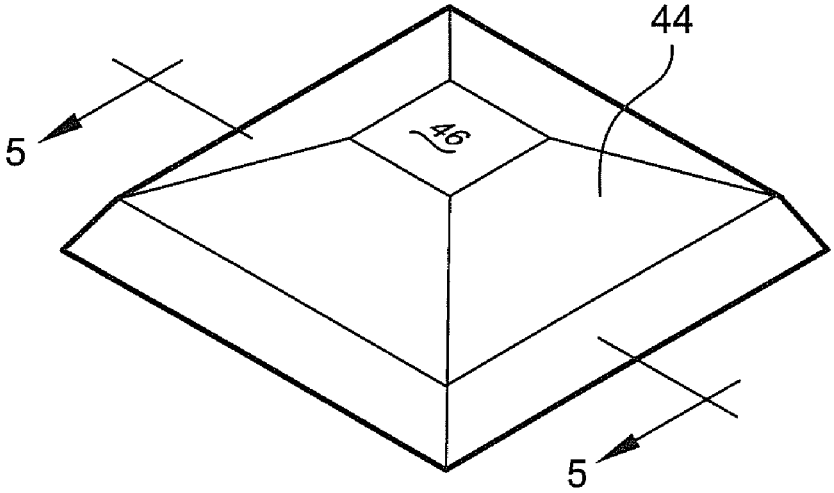
FIG. 4 is a perspective illustration of an embodiment of a bale platen made according to the second embodiment of the present invention.

It has been determined that bales of tow with flat or substantially flat surfaces and that may be easily de-baled may be made as follows:

In the first embodiment, the height of the platen, see FIG. 3, height—$H_3$, is $1 \leqq H_3 < 3$ inches (2.5-7.6 cm). The press cycle at the target pressure is between 2-8 minutes. The platens' profile is a continuous curve.

Figure 5:
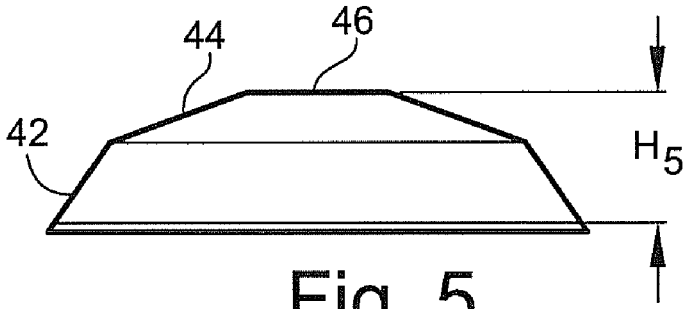
FIG. 5 is a cross-sectional view of the platen shown in FIG. 4 taken along sectional lines 5-5.

In the second embodiment, the height of the platen, see FIG. 5, height—$H_5$, is $3 \leqq H_5 < 5$ inches (7.6-12.7 cm). The press cycle at the target pressure is between 0.1-5 minutes. The platens' profile is a contoured face having at least two (2) linear sloped portions, and preferably at least three (3) linear sloped portions. Referring to FIG. 5, an example of this contoured face is illustrated. The first (or initial) sloped portion 42 is adjacent the peripheral edge of the platen. The second (or mid) sloped portion 44 is adjacent the portion 42. The third (or final or peak) sloped portion 46 is adjacent the second portion 44 and defines the uppermost surface of the platen. The first portion should have a slope greater than 5°, but less that 40°. The second portion should have a slope greater than 5°, but less that 20°. The third portion should have a slope from 0° to 15°. If the platen is symmetrical (or square); the slope of each portion will be equal. If the platen is non-symmetrical (or rectangular); the slope of each side of the portion will not be equal (opposite sides will be the same). In the non-symmetrical case, care should be taken to avoid sharp transitions between sides with different slopes, these transitions should not form sharp edges. Instead, these transitions must be gradual, that is with no less than 175° from one side to the other. No peaks at the diagonal corner transition (lines).

In the foregoing illustration of the second embodiment, the platens 36 and 38 where made of wood (e.g., pine). However, the platens may be made of other materials, for example a synthetic material (e.g., nylon, polyester) or a metal (e.g., steel). If the platens are made of these latter materials, then the height ($H_5$) may be 3 inches (7.6 cm) or less.

The foregoing may be further illustrated by the following examples:

Several fiber bale samples, as described herein below in detail, were prepared, and the growth of the top surface of each fiber bale sample was measured to determine the percent reduction in bale crown compared to the control. The percent reduction is calculated from the height difference between a control bale made from a flat platen and a trial bale made from a convex platen. The bale height is measured using a level at the highest point on the bale surface and measuring the distance from ground. The bales were then opened and tested for fiber removal performance. The number of defects during removal were then counted and given a fault index rating. The fault index rating is a visual quality check of the fiber during de-baling before processing. Over a set period of time, for example 5-10 minutes, the fiber is observed leaving the bale prior to entering the downstream equipment. The test is typically conducted at high speeds to magnify the potential for defects, for example 600 meters/minute. The rating is based on the length of the defects times a multiplier. Table I shows the scale and multipliers.

TABLE I

| DEFECT LENGTH | # DEFECTS | MULTIPLY BY | TOTALS |
|---|---|---|---|
| 0-1 inch | 5 | 1 | 5 |
| 1 inch-4 inches | 3 | 5 | 15 |

TABLE I-continued

| DEFECT LENGTH | # DEFECTS | MULTIPLY BY | TOTALS |
|---|---|---|---|
| Greater than 4 inches | 2 | 100 | 200 |
| | | TOTAL = | 220 |

The preferred bale would have the highest percent crown reduction with the lowest fault index. The results of the aforementioned test are shown below in Table II. The conditions for producing fiber bale samples were varied based on productivity and Time at Target Bale Pressure desired. Fiber bale sample 1 was produced using standard flat platens, and fiber bale sample 2-8 was produced using bale platens (wooden) made according to instant invention.

TABLE II

| Example No. | Convex Shape Depth | Time at Target Bale Pressure | Convex Shape Design | Crown Reduction | Fault Index |
|---|---|---|---|---|---|
| 1 | 0.00 in | 1.5 min | No slope | 0% | 20 |
| 2 | 2.25 in | 2.5 min | Continuous | 50% | No data |
| 3 | 2.25 in | 5.0 min | Continuous | 70% | No data |
| 4 | 2.25 in | 1.5 min | Continuous | 55% | 28 |
| 5 | 3.25 in | 1.5 min | Contoured face | 70% | 16 |
| 6 | 3.75 in | 1.5 min | Contoured face | 72% | 130 |
| 7 | 4.00 in | 1.5 min | Contoured face | 90% | 406 |
| 8 | 4.75 in | 1.5 min | Contoured face | 71% | 427 |

The present invention may be embodied in other forms without departing from the spirit and the essential attributes thereof, and, accordingly, reference should be made to the appended claims, rather than to the foregoing specification, as indicated the scope of the invention.

We claim:

1. A method for baling a cellulose acetate tow comprising the steps of:

laying the cellulose acetate tow into a can, pressing the laid tow with a press having a first platen and a second platen, each platen facing each other, each of the platens having a pyramid shape where each side of the pyramid being a contoured face, each of the contoured faces having three linear sloped portions, a first linear sloped portion located adjacent a peripheral edge of the platen having a first slope, a second linear sloped portion located adjacent the first linear sloped portion having a second slope, and a third linear sloped portion located adjacent the second linear sloped portion having a third slope, wherein the first slope being in the range of 5° to 40°, the second slope being in the range of 5° to 20°, and the third slope being in the range of 0° to 15°, and the first slope is greater than the second slope, and the second slope is greater than the third slope, packaging and securing the pressed tow, whereby the pressed tow having substantially flat surfaces.

2. The method according to claim 1 wherein a each said platen being free of air exhaust hole.

3. The method according to claim 1 wherein a height of each platen being greater than 3 inches (7.6 cm).

4. The method according to claim 1 wherein pressing is for a period in the range of 0.1 to 5 minutes.

5. The method according to claim 1 wherein each said platen being made of a material being selected from the group consisting of wood, synthetic material, or a metal.

6. A method for baling a cellulose acetate tow comprising the steps of:

laying the cellulose acetate tow into a can;

pressing the laid tow with a press having a first platen and a second platen, each platen having a contoured face, each platen being free of air exhaust holes, and a pressing time ranging from 0.1 to 5 minutes; and packaging and securing the pressed tow, whereby the pressed tow having substantially flat surfaces.

7. The method according to claim 6 wherein a height of each platen being in the range of 3 to 5 inches.

8. The method according to claim 6 wherein each said platen being made of a material being selected from the group consisting of wood, synthetic material, or a metal.

* * * * *